United States Patent [19]

Imboden

[11] Patent Number: 4,722,202

[45] Date of Patent: Feb. 2, 1988

[54] KNITTED BRIEF AND METHOD MAKING SAME

[75] Inventor: Walter H. Imboden, Burlington, N.C.

[73] Assignee: Nantucket Industries, Inc., New York, N.Y.

[21] Appl. No.: 826,775

[22] Filed: Feb. 6, 1986

[51] Int. Cl.[4] ..... A41B 9/02

[52] U.S. Cl. ..... 66/177; 2/401; 2/403; 2/406

[58] Field of Search ..... 66/177; 2/400, 401, 2/403, 406, 243 R, 243 B

[56] References Cited

U.S. PATENT DOCUMENTS 3,985,004 10/1976 Johnson et al. ..... 66/177
4,010,627 3/1977 Pernick ..... 66/177
4,048,819 9/1977 Johnson ..... 66/177
4,527,403 7/1985 Fullbright ..... 66/177

*Primary Examiner*—Ronald Feldbaum
*Attorney, Agent, or Firm*—Wolf, Greenfield & Sacks

[57] ABSTRACT

This invention is directed to a method of manufacturing knitted briefs and the briefs made by the method. In accordance therewith, two separate seamless tubular blanks are knit each with a knit-in waistband, a body portion and a crotch portion. The tubular blanks are each slit walewise, and the free coursewise edges of the crotch portions are sewn together by a crotch seam.

Thereafter the side edges of the combined blank are trimmed to define the leg openings, and narrow elastic is sewn to the side edges. The side edges of the body portions are then sewn together. The yarn at the crotch area is then bulked to further reduce the crotch width.

13 Claims, 12 Drawing Figures

KNITTED BRIEF AND METHOD MAKING SAME

INTRODUCTION

This invention relates to the manufacture of knitted garments and more particularly comprises a new and improved method of manufacturing knitted briefs as well as a new and improved product. In the following description, the knitted briefs are sometimes described as panties, as the invention has particular application with respect to ladies undergarments, but it should be appreciated that the invention has wider applications.

U.S. Pat. No. 3,985,004 issued to Johnson, et al on Oct. 12, 1976 discloses a very well known method for producing one-piece knitted panties. In accordance with the disclosure in that patent, a tubular blank of hourglass shape is knit starting with a cuff, continuing with a body portion of constant diameter, then a tapered portion of gradually diminishing diameter, next a crotch portion of generally uniform but smaller diameter than the body portion, next a tapered portion of gradually increasing diameter similar to the first tapered portion but substantially a mirror image thereof, then a second body portion of generally uniform diameter, and finally a second cuff. (When the tubular blanks from which the panties are made, either in accordance with the prior art or with this invention, are described herein in terms of their diameters, reference is being made to the effective diameters of the blanks in their relaxed state, i.e., the yarn is not being stretched in a coursewise direction.) The coursewise constriction of the tubular blank that defines the hourglass shape is formed by the use of contrasting yarns such as elastic in conjunction with stitch variations such as float stitching. The tubular blank described above is next slit longitudinally (walewise) to form a flat blank. The '004 patent states that it is an object of the invention to avoid trimming of the blank particularly at the crotch portion. Elastic may next be attached to the side edges of the tapered and crotch portions, which define the leg holes. Finally, the flat blank is folded across the crotch area so that the cuffs together form the waistband of the panty, and the folded blank is sewn along the sides of the body portions and cuffs.

Another method of manufacturing panties is disclosed in U.S. Pat. No. 4,527,403 issued to Fullbright, et al. In accordance with the disclosure of that patent, two separate tubular blanks are knit on a circular knitting machine, each tube having an inwardly turned welt or cuff at one end and being of reduced diameter at the other end. The areas of reduced diameter are created by forming mock ribs in the tube by elastic yarn incorporated in spaced apart wales and floated. coursewise between them. The elastic yarn and mock ribs create greater fabric density and greater stretchability in those areas of reduced diameter. The tubes are then slit to form flat blanks, ravels beyond the areas of reduced diameter are trimmed and simultaneously the two blanks are sewn together at their ends of reduced diameter. The areas of reduced diameter are trimmed along the sides to further narrow the joined flat blanks and form the crotch portion, elastic is secured to sides of the crotch portion, and the sides of the blanks beyond the crotch portion are sewn together to complete the panty.

There are certain disadvantages to garments constructed in accordance with either of the methods of the '004 and '403 patents, and the primary object of the present invention is to overcome them.

A one-piece garment produced as described in the '004 patent necessarily requires that half the tubular blank be produced with the knitting of the garment proceeding in the "wrong direction", that is, the diameter gradually or suddenly increases from the narrowest point at the crotch area to the widest point at the waistband, and the knitted loops proceed in the "wrong direction" in one-half of the finished product. The machine proceeding in that direction is required to produce a cuff (waistband) at the last knit end of the tube, and a waistband so produced does not have the finished appearance of a waistband formed at the head end of the tubular blank. The last knit waistband section is left with an unsightly ruffled edge which does not match the other section of the waistband knit at the leading end and with which it is joined when the garment is slit, folded and sewn. A turned cuff formed at the last knit end is also susceptible to runs beginning at the ruffled edge. Furthermore, while various attempts have been made to provide sufficient taper in the tubular blank so as to obtain the desired width at the crotch portion without trimming, including the method taught in the Johnson U.S. Pat. No. 4,048,819 issued Sept. 20, 1977, none to applicant's knowledge, has appeared commercially, and it is necessary to significantly trim the flat blank along the sides of the crotch portion and tapered portion to narrow the garment.

Another disadvantage of the manufacturing method described in the '004 patent is the length and complexity of the machine programming required to knit the full length of the one-piece tubular blank, particularly if patterning stitches are to be used in the brief. The cycle drums used in standard 400 needle circular machines have a limited programming capacity, which is sorely tested by the long tubular blank. This limitation is more constraining when fancy garments are attempted. The pattern drum, because of the number of changes required to knit the entire tubular blank, has a limited capacity for design, pattern and crotch variations.

A garment produced in accordance with the disclosure of the '403 patent has other disadvantages. For example, the mock ribs gather together at the crotch seam which joins the two blanks, and consequently the seam does not lie flat. The elastic yarn which is used to reduce the width of the panty at the crotch creates other problems which are also present in the one-piece panty (when it includes the elastic yarn). The elastic yarn is difficult to control in knitting and therefor the crotch width may not be uniform from garment to garment. Furthermore, the sizing of the panty is difficult to control because the tension on elastic yarn varies due to yarn friction on the guide surfaces and package tension differences. The elastic yarn is also more susceptible to breakage and other knitting difficulties (some of which are related to the yarn binders on the dial cap), than the other yarns. The elastic yarn is also more costly. The elastic yarn also slows the sewing operation because the operator must minimize puckering when the crotch portions are sewn together and the elastic is sewn to the leg openings. Furthermore, the elastic yarn slows down the knitting speed because of the variations in tension and coefficient of friction.

In accordance with the preferred embodiment of the present invention, two separate tubular blanks are produced on the circular knitting machine, one for the front of the garment and one for the back. Each of the two blanks is knit in the same direction, first with a waistband, then a body portion of generally uniform diameter, and finally a crotch portion of the same diameter as the body portion. The tubular blanks may end with a ravel at the bottom beyond the crotch portion. A waistband cuff is formed by an outturned welt at the head end of each tubular blank, and therefore each is attractive, and the two match one another when the two blanks are subsequently sewn together. Moreover, no part of the waistband is susceptible to runs through the transfer loops.

The crotch portions of the tubular blanks may be knit with the same yarn as the body portion, typically textured nylon, but employ a different stitch than in the body. For example, alternate courses of the crotch portion may float across several loops, and the floats may be in line with one another to form a ribbed look, be uniformly staggered in a zig-zag pattern to produce a waffle effect, or the floats may be in a random pattern, depending upon the look to be achieved at the crotch area.

The two circular blanks are slit walewise and the crotch portions of each are sewn together in a coursewise direction while at the same time trimming the ravels.

After the flat blanks are stitched together at the crotch area, the resulting long rectangular blank is simultaneously trimmed along the side edges to narrow the crotch area and form the leg openings of the panty, as elastic is stitched to the side edges.

The blank is then folded across the narrowed portion and the sides of the body portions of the two blanks are seamed together.

If the panties are to be dyed, that step is performed next, and finally the goods may be autoclaved. This step is performed by mounting the panties on rings or other suitable forms and placing them in a steam pressure vessel. Autoclaving at 240° F. for seven minutes has proved to be satisfactory, although other temperatures and times may be suitable as well. This step sets the panties into a pleasing shape and takes out the wrinkles while allowing the crotch yarn to relax or bulk up and thereby further reduce the crotch width.

A panty constructed in accordance with this invention has many advantages over the prior art. For example, the manufacturing costs are less because of the elimination of the costly elastic yarn at the crotch area, the faster knitting speeds and easier sewing operations. Furthermore, the seams in the panty are flat, there is better width and size control, and the same program sequence (differing only by the number of courses knit in the various portions) can be used to knit the front and back blanks.

This invention will be better understood and appreciated from the following detailed description of the method of manufacture and the product, read in connection with the accompanying drawings.

BRIEF FIGURE DESCRIPTION

DETAILED DESCRIPTION OF THE DRAWINGS

Figure 1:
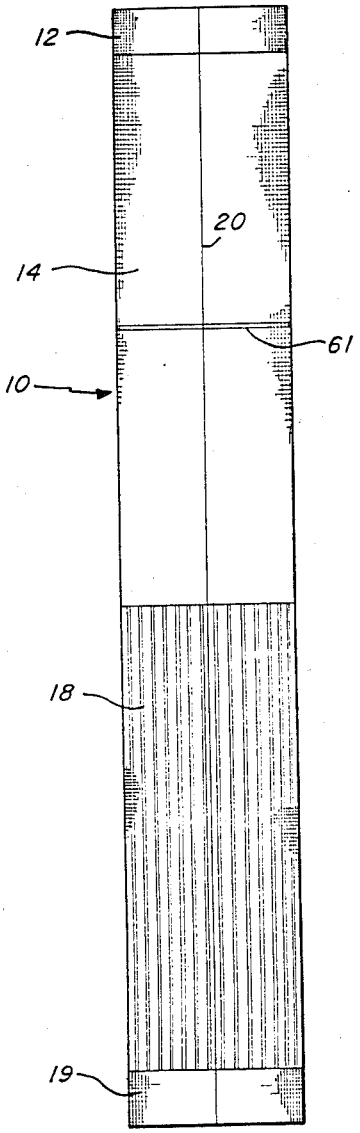
FIG. 1 is a plan view of a tubular blank from which the front of the brief is formed.

FIG. 1 illustrates a tubular blank 10 which may typically be produced on a 400 needle circular knitting machine. The blank 10 includes a knit-in waistband 12, main body portion 14 of generally uniform diameter, and crotch portion 18, also of uniform diameter and of the same or similar diameter as the body portion 12. The crotch portion in turn ends in a ravel 19. The crotch portion 18 preferably has a cotton yarn incorporated into spaced courses which, when the garment is formed, provides a soft absorbent lining for the garment at that region. The crotch stitching will be described in greater detail below in connection with FIG. 10. A visible cutting line 20 is knit into the blank in a walewise direction, which serves as a guide when the tubular blank is slit either manually or automatically in a longitudinal direction.

Figure 2:
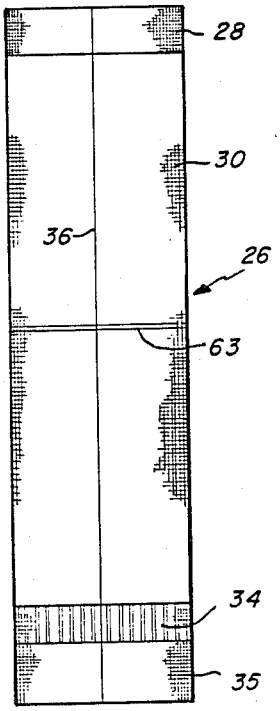
FIG. 2 is a plan view of a tubular blank from which the back of the brief is formed.

The blank 26 shown in FIG. 2 from which the back of the panty is formed is similar but not identical to the blank 10 shown in FIG. 1. The blank 26 also may be knit on a 400 needle circular knitting machine and includes a knit-in waistband 28, a main generally cylindrical body portion 30, optionally a short ribbed portion 34 of the same or similar diameter as the body portion 30, and a ravel 35. The short ribbed portion may be knit into the tubular blank and be trimmed from the blank along with the ravel 35 when the two blanks are seamed together as more fully described below.

Both blanks 10 and 26 are knit in the same direction which as described above permits the use of a standard set-up in the knitting machine controls. This is the conventional direction of knitting with a made up and transferred cuff knit first. Blank 26 does not necessarily but may include a cotton yarn lining at the crotch area. Like the blank 10, circular blank 26 includes a visible cutting line 36 which extends walewise from the waistband 28 to the ravel 35.

Figure 3:
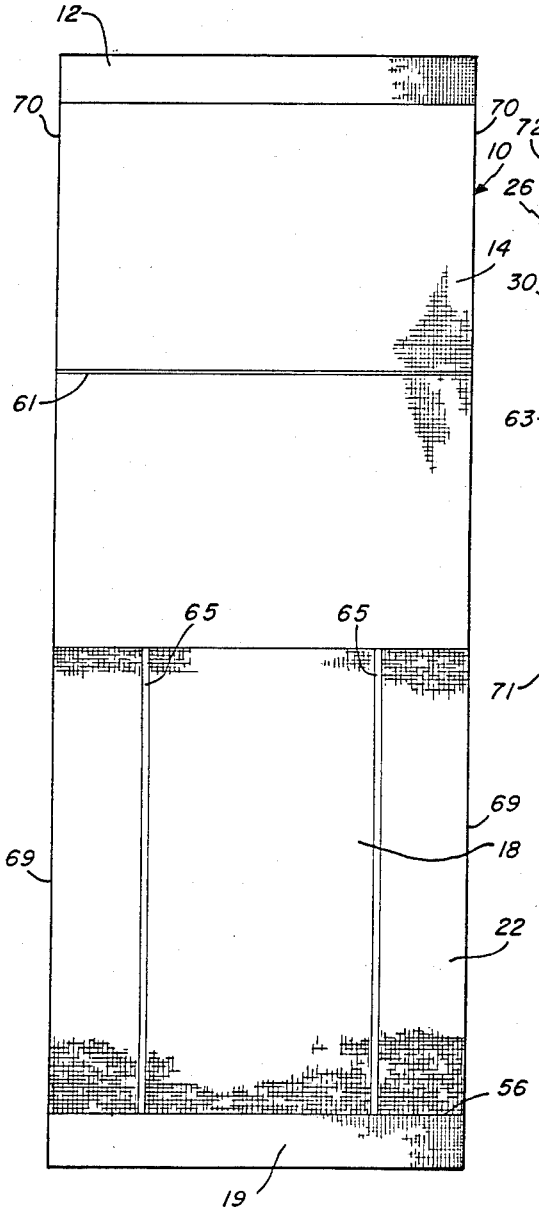
FIG. 3 is a plan view of the inside of a flat blank formed from the tubular blank of FIG. 1 and from which, in turn, the front of the brief is formed.
Figure 4:
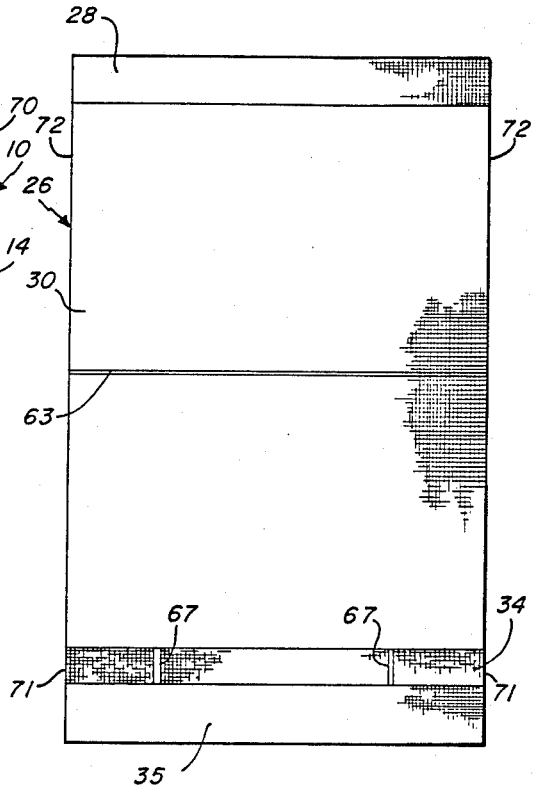
FIG. 4 is a plan view of the inside of a flat blank formed from the tubular blank of FIG. 2 and from which, in turn, the back of the brief is formed.

FIGS. 3 and 4 show the tubular blanks 10 and 26 after they have been slit along the cutting lines 20 and 36, respectively and opened flat with their faces down. In FIG. 3, the cotton lining 22 is shown incorporated into the crotch portion 18 on the inside surface. In FIGS. 1 and 2 ribs are suggested on the faces of the crotch areas 18 and 34, which may typically be formed by float stitching as is described more fully below.

While in the embodiment shown, no transitional area is shown between the body portions 14 and 30 and the crotch portions 18 and 34 respectively, it should be understood that float stitching or other techniques such as tuck stitch construction may be employed to form a fan effect of ribs or pleats.

Figure 5:
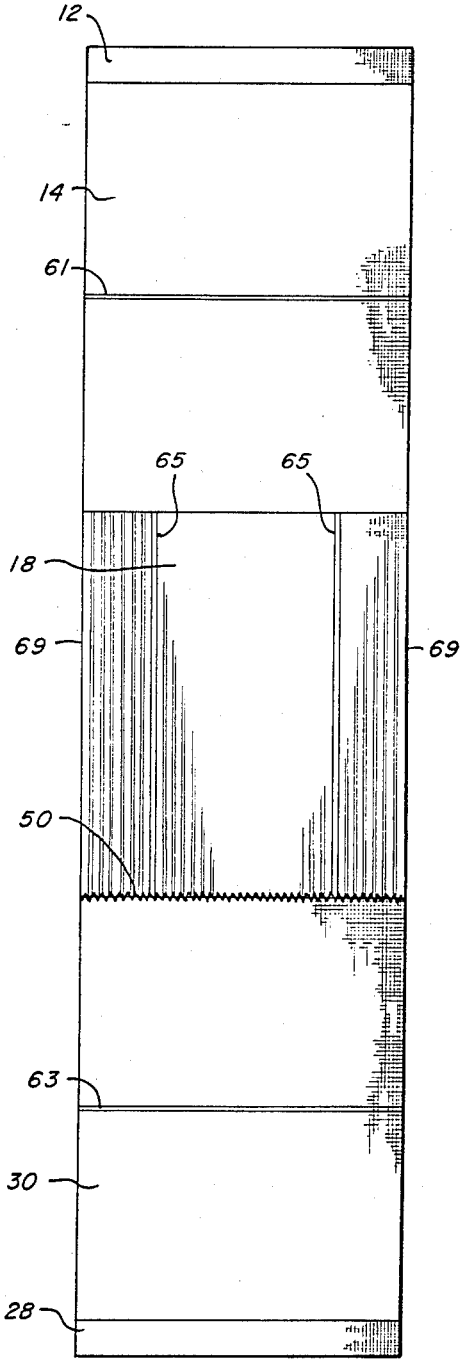
FIG. 5 is a plan view showing the blanks of FIGS. 3 and 4 after the ravels have been trimmed and the blanks have been stitched together at the rear of the crotch portion.

The next step in the manufacturing operation is to place the flat blanks 10 and 26 face in against one another and stitch them together by the seam 50 to produce the combined blank shown in FIG. 5. The machine which stitches the two blanks together may also trim the ravels 19 and 35 from the respective flat blanks. In FIG. 5 the crotch area (34 in FIGS. 2 and 4) has been cut from the back blank along with the ravel 35 so that seam 50 lies at the very back of the crotch of the completed panty. The seam 50, however, could be somewhat forward of the back edge of the crotch in which case some of the crotch portion 34 of the blank 26 would remain. It will be noted in FIG. 3 that the lining 22 of cotton yarn does not extend into the ravel 19 but rather terminates at the course 56 where the seam 50 joins the two flat blanks together.

Figure 6:
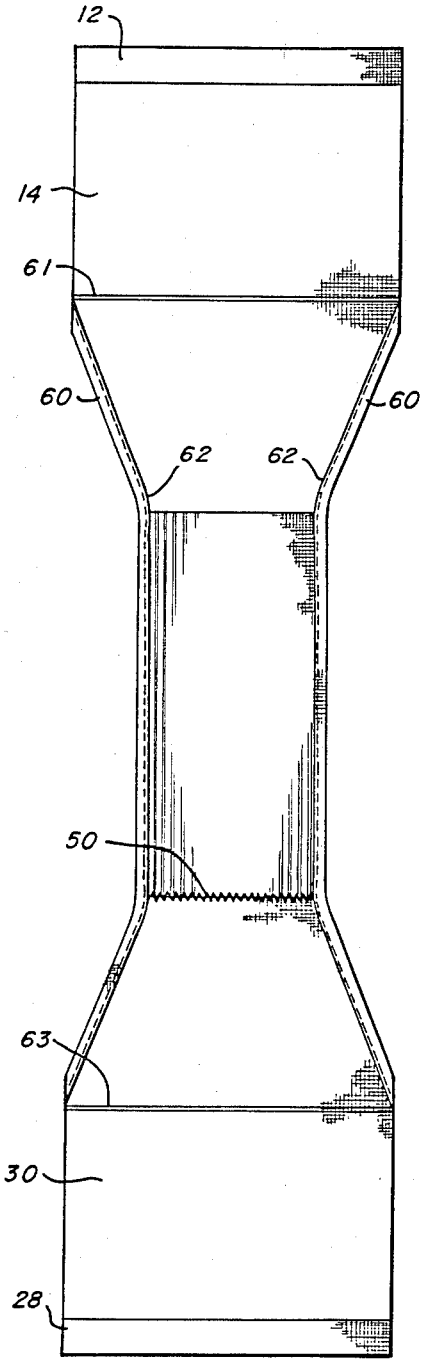
FIG. 6 is a plan view of the face of the partially formed brief shown in FIG. 5 layed out flat and with the side edges trimmed and elastic sewn to the edges which define the leg openings when the brief is completed.

After the blanks are stitched together by overedge seam 50 and the ravels 19 and 35 are trimmed from the blanks, the side edges are trimmed to form the leg openings and simultaneously the narrow elastic fabric 60 may be stitched along the side edges 62 which define the leg openings 64 of the partially formed panties as shown in FIG. 6. The trimming and stitching of the elastic need not be done simultaneously, although that is presently preferred. The beginning and end of the portion of the edges 62 over which the elastic is stitched may be delineated by a stripe knit into each of the original tubular blanks such as by a soluble yarn with color as suggested at 61 and 63 in FIGS. 1 and 3, and 2 and 4, respectively. That yarn will be removed when the garment is washed in the finishing operations. Obviously, other techniques may be used to indicate where the leg openings begin and end and the extent and position of the elastic.

It will be noted in FIGS. 3–5 that stitching guides 65 and 67 which extend in a walewise direction in from original side edges 69 and 71 are knit into the crotch fabric 18 and 34 respectively. Obviously, these stitch guides may be achieved in other ways as well. Moreover transitional markings between the stripes 61, 63 and the guides 65, 67 may be incorporated into the blanks as well to assist cutting of the side edges and/or stitching the elastic. The stitch guides 65 and 67 in combination with the coursewise colored threads 61 and 63 indicate to the sewing operators where the crotch is to be trimmed along the sides to form the edges 62 that define leg openings 64 and where the elastic fabric is to be stitched. The narrow elastic fabric strips 60 are stitched to the face of the garment, that is, they overlap the outside edges of the garment and provide a finished appearance for it. The strips 60 which are essentially stretchable only in a longitudinal direction enable the garment to stretch so that the leg openings are large enough to encircle the thighs of the wearer.

Figure 7:
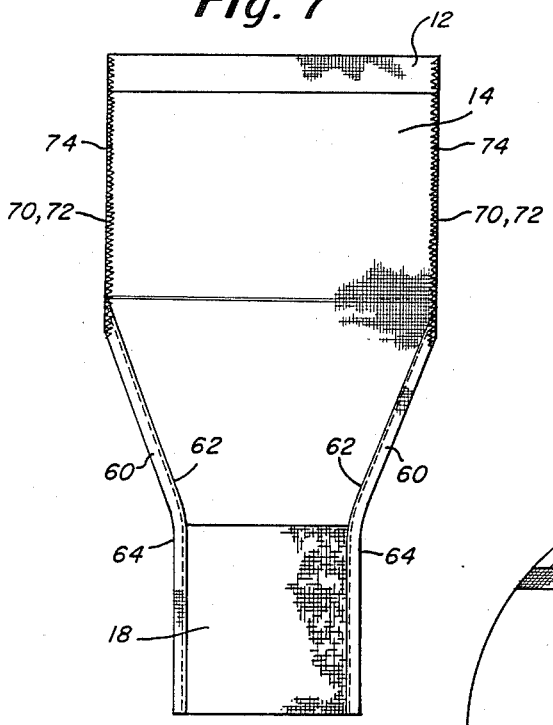
FIG. 7 is a plan view of the brief turned inside out and showing the stitching which joins the blanks along the sides of the garment above the leg openings.

The assembling of the garment is completed by overedge seams 74 which join the side edges 70 of the front panel 10 to the side edges 72 of the back panel 26 with the garment turned face in, as suggested in FIG. 7. The seams 74 along the sides of the garment may be the same as the crotch seam 50 and form small ribs along the insides. A label (not shown) may be incorporated into one of the side seams 74 if desired.

The body portions 14 and 30 of blanks 10 and 26 may typically be knit of plain stitching with 70–100 denier textured nylon. Patterns may also be incorporated into the body portions 14 and 30 if desired and untextured yarn may be used for that purpose. The crotch portions as suggested above may be knit with the same or similar yarns. If for example, the manufacturer prefers to keep the crotch area white, polyester yarn may be used in the crotch area, instead of nylon. (The typical acid dyes used for nylon are rejected by the polyester, and they remain white when the garment is dyed. No elastic yarn is used in the crotch area.

Figure 10:
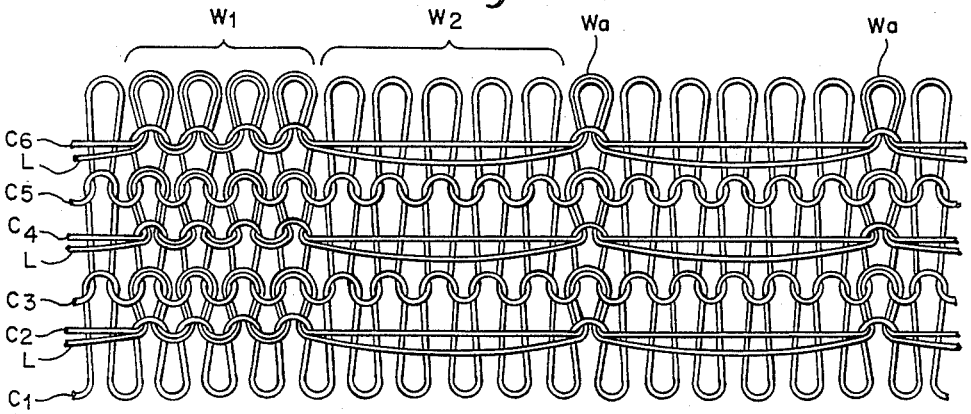
FIG. 10 is a stitch diagram of one form of stitching which may be used in the crotch area of this invention.

In FIG. 10 a few courses of knitting are suggested as one possible construction for the crotch portions. In this arrangement, the body of the crotch are includes alternate courses $C_1$, $C_3$, $C_5$ etc. typically knit of untextured nylon while the alternate courses $C_2$, $C_4$, $C_6$ etc. are of textured nylon. A cotton yarn L is fed with the textured nylon (or textured polyester as mentioned above) to form the lining on the inside face of the crotch area as is well-known in the art.

Figure 11:
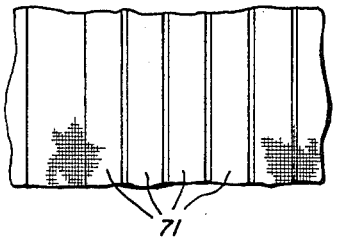
FIG. 11 is an enlarged plan view of a portion of the panty fabric stitched in accordance with FIG. 10.

In the first section $W_1$ of the portion of the courses illustrated, jersey or plain stitching is utilized to form the trim guide 65. In the next section $W_2$ illustrated, the textured nylon courses $C_2$, $C_4$, $C_6$ etc. with the cotton yarn are floated across five wales and then knit with a single wale and again floated across five wales and knit with one. This arrangement produces uniform ribs 71 in the crotch portion as suggested in FIG. 11. It will be appreciated that each float produces one rib, and this stitch pattern may continue about the entire tubular blank, except for the guides which may be formed on each side of the cutting line. While the drawing suggests that each float is over five wales, a different number of wales may be used. The number will determine the width of the ribs and the bulk of the crotch fabric. It should also be appreciated that the spaced wales $W_a$ with which the courses $C_2$, $C_4$, $C_6$ etc. are knit need not be aligned with one another in each course as shown. Rather, they may be staggered, be arranged in a zig-zag pattern, be randomly offset, or take some other form and produce different patterns in the crotch such as a waffle pattern etc. Furthermore, the floats need not be uniform i.e. they may span different number of wales.

Figure 9:
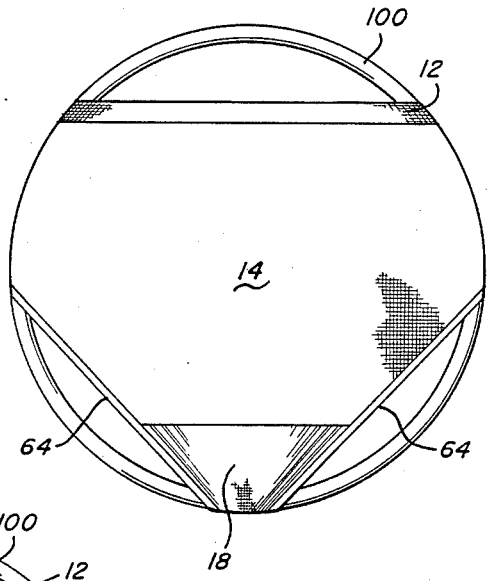
FIGS. 8 and 9 are plan views showing the panty of FIG. 7 mounted on a ring as it appears before and after autoclaving respectively.
Figure 8:
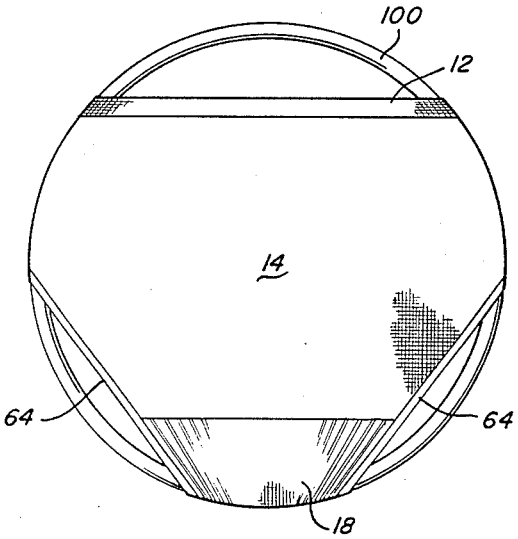

The final step in the manufacture of the panty in accordance with the present invention is to stretch the panty over a circular ring or other form and subject it to autoclaving as suggested in FIGS. 8 and 9. In FIGS. 8 and 9 a circular ring 100 is shown, which may be made of ⅜ inch nylon tubing and have a diameter of approximately twelve inches. The panty is stretched over the ring as shown in FIG. 8, and it will be appreciated that the ring holds the shape of the body portion of the panty while the crotch portion is free to relax. That is, the ring does not prevent the width of the crotch from relaxing and/or shrinking when subjected to autoclaving. For best results, the operator should somewhat bunch the crotch portion of the panty so as to enable the textured yarn to relax and shrink freely when autoclaved. If the crotch portion is stretched out over the ring, the friction may impede relaxation and shrinkage of the textured yarn. The operator may, in fact, regulate the final width of the crotch portion by selecting the position of the fabric on the ring or other form. It should also be appreciated that while a single pair of panties is shown mounted on the ring in FIG. 8, an additional pair or pairs may also be mounted on the ring. If two panties are on a ring, they may be displaced 180° from one another. The autoclaving may be carried out in a pressure vessel at steam of temperatures approximately 240°, for approximately seven minutes. This step causes the textured yarn in the crotch area to bulk up so as to reduce the crotch width as suggested in FIG. 9. The textured yarn in the body portion, however, cannot bulk up because it is restrained from doing so by its position on the ring 100. Autoclaving also gives the panty a pleasing shape and removes the wrinkles from the material. This step serves to reduce the crotch width sufficiently so as to produce a comfortable and attractive garment. It should be noted that if the goods are to be dyed, that step may take place just before autoclaving. The reduced crotch width may also be achieved merely by steaming the garment, for steaming alone would cause the yarn to relax and shrink. Autoclaving, however, has a beneficient cosmetic effect as well.

Figure 12:
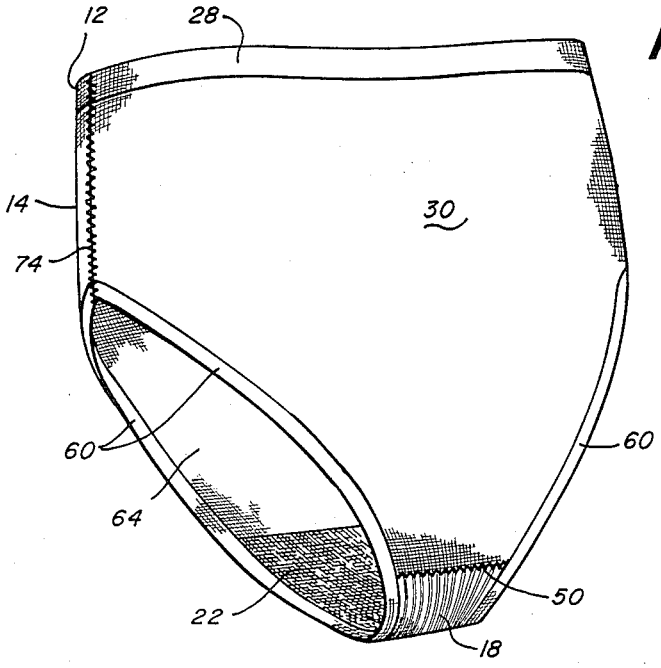
FIG. 12 is a perspective view of a finished brief constructed in accordance with the present invention.

In the completed garment shown in FIG. 12, the seam 50 is disposed at the rear of the crotch area of the panty. The location of the seam 50 can be changed by lengthening or shortening the crotch portions of each blank. It is preferred, however, that the crotch seam be located at the back of the panty.

The method of manufacture and the resulting product of this invention have many advantages over the prior art methods and products shown in U.S. Pat. Nos. 3,985,004, 4,048,819 and 4,527,403. For example, the knitting machine program for the manufacture of the garment in accordance with the present invention is greatly simplified over that required to manufacture the one-piece garments shown in the '004 and '819 patents. This becomes most significant when patterned effects in the bodies of the panties are used. In the manufacture of the hour glass configured tubular blank of these prior art patents, the tapers decrease in opposite directions. That is, the effective diameter of the knitted cylinder decreases first and thereafter increases on opposite sides of the crotch portion. The natural graduation if used in circular knitting machines is from a larger to a smaller diameter and not from a smaller to a larger diameter. In accordance with the present invention, the tubular blanks are both knit in the same, natural direction. Second, the machine programming is significantly shorter and simpler for the blanks of the present invention than for the one-piece construction. The program for each blank of the present invention is approximately one half as long as the program used to manufacture the blanks in the '004 and '819 patents. Because the programming is approximately one half as long as in the prior art technique, there are many more available "moves" to achieve patterning or structural changes. Third, the patterning procedures are greatly simplified and patterning capacity is much less likely to be exhausted because of the fewer changes required to achieve the basic design. This in turn permits greater variation and complexity in the patterns introduced.

Yet another advantage of the present invention is that the front and back panels of the finished brief are comprised of stitches which have been knit in the same direction. Consequently, the front and back portions of the waistband can be "made up"0 on the knitting machine in the conventional way, thus eliminating the undesirable flap that is unavoidable in the last-knit waistband portion in the one-piece garment of the prior art. That unsightly flap is characteristic of the unconventional procedure of knitting an elasticized band at the end rather than the beginning of a garment blank. Moreover, in the so-called backward procedure used in knitting the lower half of the one-piece tubular blank, there is no practical "run guard" or "run proof" stitch available to prevent a run from starting in the last knit cuff and proceeding into the body of the panty against the direction of knitting. In garments knit in the conventional direction such runs rarely develop, and even when they do occur, a simple run-proof mesh stitch will arrest the run.

The advantages of the present method of manufacture over the method described in the '403 patent are many. The elimination of the elastic yarn at the crotch area reduces both the material costs in the garment and the machine time required to make it. Clearly, the elastic yarn is more costly than the nylon or other fiber which may be used in accordance with the present invention. Furthermore, the cycle time for manufacturing the blanks in accordance with the present invention is significantly faster than the cycle time required for the method of the '403 patent as the elastic yarn significantly slows down the speed of operation of the machine. Furthermore, the stitcher who sews the crotch and the elastic trim at the leg openings does not have to deal with puckering which is present when the crotch area is made with elastic yarn as taught in the '403 patent. The elimination of the elastic yarn also provides better width control of the crotch area and control of the sizing of the panty. The seams lie flat as neither of the stitched together parts will pucker. The nylon or other non-elastic yarn runs better on the machine than the elasticized yarn which sometimes breaks and cause other problems because of the changes in its coefficient of friction and/or tension.

Another advantage of the method of this invention is that because the same yarns and same construction sequences are used both in the front and back of the garment, the same programming sequence may be employed, varying only the number of courses in each portion.

Having described this invention in detail, those skilled in the art will appreciate that numerous modifications may be made of the invention without departing from its spirit. Therefore, it is not intended that the breadth of this invention be limited to the single embodiment illustrated and described. Rather, the breadth of this invention is to be determined by the appended claims and their equivalents.

I claim:

1. A method of producing a knitted brief having front and back panels with converging side edges that define leg openings, a crotch portion and a waistband, comprising the steps of (a) knitting first and second seamless tubular blanks each of a substantially constant diameter and with a waistband welt at one end followed by a body portion and a crotch portion, said crotch portion having a textured yarn in at least some of its courses, (b) slitting the first and second tubular blanks walewise and opening them up to provide first and second flat blanks, respectively, (c) stitching a coursewise crotch seam to join the crotch portrons of the two flat blanks so that the blanks are connected end to end with the welts at the opposite ends and the slits defining the side edges of the resulting combined blank, the sewn together crotch portions defining a crotch area in the combined blank, (d) trimming the side edges of the combined blank to narrow the crotch area of the combined blank and form leg openings therein, (e) stitching elastic narrow fabric to the side edges of the combined blank along the leg openings, (f) stitching the sides of the body portirons of the first and second blanks together so that the body portions form the front and back of the brief, (g) stretching the stitched together brief over a form which allows the yarn in the crotch area to bulk and which prevents yarn in the front and back of the brief from bulking, and (h) causing the textured yarn in the crotch area to bulk up and thereby reduce the crotch width of the brief.

2. A method as defined in claim 1 further characterized by knitting each tubular blank in the same direction with the waistband welt at the top of each tubular blank.

3. A method as defined in claim 2 further characterized by simultaneously trimming the side edges and stitching on the narrow elastic fabric.

4. A method as defined in claim 1 further characterized by said crotch portions being knit free of elastic yarn.

5. A method as defined in claim 1 further characterized by said crotch portions being knit of alternate courses of untextured and textured yarn with the textured yarn being knit in spaced wales and floated between them.

6. A method as defined in claim 1 further characterized by feeding a cotton yarn with at least some of the courses of textured yarn in the crotch portion of one blank to form a lining on the inside face of the crotch area of the panty.

7. A method of producing a knitted brief having front and back panels with converging side edges that define leg openings and a crotch portion, comprising the steps of (a) knitting first and second seamless tubular blanks and each of a substantially constant diameter and with a body portion and a crotch portion, the crotch portion of at least one blank having a textured yarn in at least some of its courses, (b) slitting the first and second tubular blanks walewise and opening them up to provide first and second flat blanks, respectively, (c) stitching a coursewise crotch seam to join the crotch portions of the two flat blanks so that the blanks are connected end to end with the slits defining the side edges of the combined blank, said crotch portions of the blanks defining a crotch area in the combined blank, (d) trimming the side edges of the blanks to narrow the crotch area of the combined blanks and form leg openings therein, (e) stitching the sides of the body portions of the first and second blanks together so that the body portions form the front and back of the brief, and (f) Causing the textured yarn to bulk up and thereby reduce the width of the crotch area of the brief.

8. A method as defined in claim 7 further characterized by knitting a waistband welt into the first knit coursewise edge of the body panel of each tubular blank.

9. A method as defined in claim 7 further characterized by stitching narrow elastic fabric onto the side edges of the combined blanks a the leg openings.

10. A method of making a knitted brief, comprising the steps of knitting a brief blank with a textured yarn in the crotch area and stitching the blank together to form the brief with a crotch, front and back, mounting the brief on a form which permits the yarn in the crotch to relax while preventing the yarn in the front and back from relaxing, and thereafter autoclaving the brief while on the form to bulk the yarn in the crotch so as to narrow the width of the crotch.

11. A method fo making a knitted brief, comprising the steps of knitting a brief blank with a textured yarn in the crotch area and stitching the blank together to form the bried with a crotch, front and back, mounting the brief on a form which permits the yarn in the crotch to relax while preventing the yarn in the front and back from relaxing, and thereafter causing the textured yarn in the crotch to bulk and/or shrink so as to narrow the width of the crotch.

12. A method of making a knitted brief, comprising the steps of knitting a brief blank with a textured yarn in the crotch area and stitching the blank together to form the brief with a crotch, front and back, and thereafter causing the textured yarn in the crotch to bulk and/or shrink so as to narrow the width of the crotch.

13. A method of producing a knitted brief having front and back panels with converging side edges that define leg openings and a crotch portion, comprising the steps of (a) knitting first and second seamless tubular blanks each of a substantially constant diameter and with a body portion, one of said blanks having a crotch portion, said crotch portion having a textured yarn in at least some of its courses and with the textured yarn being knit spaced wales and floated across intervening wales, (b) slitting the first and second tubular blanks walewise and opening them up to provide first and second flat blanks, respectively, stitching a coursewise crotch seam to join the crotch portion of the one blank to the second blank so that the blanks are connected end to end with the slits defining the side edges of the combined blanks, said crotch portion defining a crotch area in the combined blank, (c) trimming the side edges of the blanks to narrow the crotch area of the combined blanks and form leg openings therein, (d) stitching the sides of the body portions of the first and second blanks together so that the body portions form the front and back of the brief, and (e) Causing the textured yarn to bulk up and thereby reduce the width of the crotch area of the brief.

* * * * *